US010641011B2

(12) United States Patent
Klinkman et al.

(10) Patent No.: US 10,641,011 B2
(45) Date of Patent: May 5, 2020

(54) BAG AND BRACKET ASSEMBLY FOR A BAG

(71) Applicants: ACCO Brands Corporation, Lake Zurich, IL (US); Alex Klinkman, Hayward, CA (US); Brian B. Bautista, South San Francisco, CA (US); Endrit Hajno, Brooklyn, NY (US); Jason Li, Shenzhen (CN); John McGillin, Branford, CT (US); Leslie Dotson, Carson, CA (US)

(72) Inventors: Alex Klinkman, Hayward, CA (US); Brian B. Bautista, South San Francisco, CA (US); Endrit Hajno, Brooklyn, NY (US); Jason Li, Shenzhen (CN); John McGillin, Branford, CT (US); Leslie Dotson, Carson, CA (US)

(73) Assignee: ACCO Brands Corporation, Lake Zurich, IL (US)

( * ) Notice: Subject to any disclaimer, the term of this patent is extended or adjusted under 35 U.S.C. 154(b) by 124 days.

(21) Appl. No.: 15/762,382

(22) PCT Filed: Dec. 9, 2015

(86) PCT No.: PCT/CN2015/096780
§ 371 (c)(1),
(2) Date: Mar. 22, 2018

(87) PCT Pub. No.: WO2017/096552
PCT Pub. Date: Jun. 15, 2017

(65) Prior Publication Data

US 2018/0298645 A1 Oct. 18, 2018

(51) Int. Cl.
*E05B 65/52* (2006.01)
*A45C 13/20* (2006.01)
(Continued)

(52) U.S. Cl.
CPC ..... *E05B 65/52* (2013.01); *A45C 13/103* (2013.01); *A45C 13/18* (2013.01); *A45C 13/20* (2013.01);
(Continued)

(58) Field of Classification Search
CPC ..... E05B 65/52; E05B 67/383; E05B 73/00; A45C 13/103; A45C 13/20
(Continued)

(56) References Cited

U.S. PATENT DOCUMENTS 2,905,230 A * 9/1959 Gabriel ..... A47C 7/38 297/410
3,210,971 A 10/1965 Vandamme
(Continued)

FOREIGN PATENT DOCUMENTS

CN 2674923 2/2005
CN 103653564 3/2014
(Continued)

OTHER PUBLICATIONS

Extended European Search Report for Application No. 15910027.0 dated Oct. 18, 2018 (9 pages).
(Continued)

*Primary Examiner* — Suzanne L Barrett
(74) *Attorney, Agent, or Firm* — Michael Best & Friedrich LLP

(57) ABSTRACT

A bag (10) includes a body having a first portion (26) and a second portion (30) defining a storage compartment therebetween. The bag also includes a zipper (18) with a slider (60) movable along the body and a pull (64). The bag further includes a bracket assembly (22) having a base (82) defining a recess for receiving a portion of the pull, and a cover (86) movable between an open position and a closed position, in which the cover substantially covers the recess to inhibit
(Continued)

removal of the portion of the pull from the recess. The bracket assembly (22) also includes a first lock attachment point (90) configured to receive a first type of lock to secure the cover to the base, and a second lock attachment point (94) apart from the first lock attachment point (90). The second lock attachment point (94) is configured to receive a second type of lock to secure the cover to the base.

18 Claims, 5 Drawing Sheets

(51) Int. Cl.
*A45C 13/18* (2006.01)
*E05B 73/00* (2006.01)
*A45C 13/10* (2006.01)
*E05B 67/38* (2006.01)

(52) U.S. Cl.
CPC ..... *E05B 67/383* (2013.01); *E05B 73/00* (2013.01); *E05B 73/0005* (2013.01)

(58) Field of Classification Search
USPC ..... 70/68
See application file for complete search history.

(56) References Cited

U.S. PATENT DOCUMENTS

| | | | | | |
|---|---|---|---|---|---|
| 3,319,743 | A * | 5/1967 | Pelavin | A44B 19/301 | 190/120 |
| 3,597,945 | A * | 8/1971 | Feinberg | A44B 19/301 | 70/68 |
| 3,978,697 | A * | 9/1976 | Bako | A44B 19/301 | 70/68 |
| 4,066,195 | A * | 1/1978 | Dickler | A45C 13/18 | 190/101 |
| 4,817,769 | A * | 4/1989 | Saliba | A44B 19/301 | 190/120 |
| 4,884,419 | A | 12/1989 | Ling | | |
| 5,136,864 | A | 8/1992 | Spiekermann et al. | | |
| 5,557,954 | A | 9/1996 | Ling | | |
| 5,689,979 | A | 11/1997 | Yu | | |
| 5,927,110 | A | 7/1999 | Yu | | |
| 6,202,455 | B1 | 3/2001 | Su | | |
| 6,308,541 | B1 | 10/2001 | Stowe | | |
| 6,533,335 | B2 | 3/2003 | Hudson | | |
| D480,621 | S | 10/2003 | Ling | | |
| 6,912,880 | B2 | 7/2005 | Ling et al. | | |
| 7,086,255 | B2 | 8/2006 | Reason | | |
| 7,516,523 | B2 * | 4/2009 | Okot | A44B 19/262 | 24/382 |
| 8,096,150 | B2 * | 1/2012 | Lai | A44B 19/301 | 70/21 |
| 8,161,778 | B1 * | 4/2012 | Ma | E05B 35/007 | 70/21 |
| 8,516,633 | B2 | 8/2013 | Dobin | | |
| 8,661,861 | B2 | 3/2014 | Lai | | |
| 8,769,305 | B2 | 7/2014 | Blaisdell | | |
| 8,812,868 | B2 | 8/2014 | Blaisdell et al. | | |
| 8,910,679 | B2 | 12/2014 | Avganim | | |
| RE45,429 | E | 3/2015 | Ling et al. | | |
| 9,194,158 | B2 * | 11/2015 | Lai | A45C 13/103 | |
| 9,545,158 | B2 | 1/2017 | Goldberg | | |
| 10,258,130 | B2 * | 4/2019 | Janzen | A45C 13/103 | |
| 2003/0066170 | A1 * | 4/2003 | Huang | A44B 19/301 | 24/387 |
| 2004/0237605 | A1 | 12/2004 | Lin et al. | | |
| 2006/0254329 | A1 | 11/2006 | Yu | | |
| 2006/0283215 | A1 * | 12/2006 | Manthe | E05B 67/383 | 70/14 |
| 2007/0124901 | A1 * | 6/2007 | Cyr | A44B 19/262 | 24/429 |
| 2007/0240766 | A1 * | 10/2007 | Brojanac | E05B 67/383 | 137/385 |
| 2008/0236212 | A1 | 10/2008 | Ma | | |
| 2012/0180271 | A1 | 7/2012 | Avganim | | |
| 2012/0311785 | A1 | 12/2012 | Goldberg | | |
| 2013/0091906 | A1 | 4/2013 | Chen | | |
| 2013/0121621 | A1 | 5/2013 | Misner | | |
| 2013/0299540 | A1 | 11/2013 | Avganim | | |
| 2014/0060988 | A1 | 3/2014 | Lai | | |
| 2015/0014109 | A1 | 1/2015 | Lai | | |
| 2015/0040622 | A1 | 2/2015 | Meersschaert et al. | | |
| 2016/0032620 | A1 | 2/2016 | Yu | | |
| 2017/0295892 | A1 * | 10/2017 | Goldberg | A47C 31/007 | |
| 2018/0279735 | A1 * | 10/2018 | Paul | A45C 13/103 | |

FOREIGN PATENT DOCUMENTS

| | | | | |
|---|---|---|---|---|
| CN | 107514188 | * | 12/2017 | A45C 13/10 |
| DE | 9307720 U1 | | 6/1994 | |
| WO | WO-2017096552 A1 | * | 6/2017 | A45C 13/20 |

OTHER PUBLICATIONS

International Search Report and Written Opinion for Application No. PCT/CN2015/096780 dated Sep. 18, 2016 (8 pages).
First Office Action from the Chinese Intellectual Property Office for Application No. 201580085206.1 dated Jul. 3, 2019 (26 pages including English translation).
Office Action issued by the China National Intellectual Property Administration for Application No. 201580085206.1 dated Jan. 3, 2020 (11 pages including English translation).

* cited by examiner

BAG AND BRACKET ASSEMBLY FOR A BAG

BACKGROUND

The present invention relates to a bag and a bracket assembly for a bag, such as a suitcase.

Bags commonly include zippers for opening and closing compartments of the bags. Some bags include locks or other devices to inhibit the bags from being opened by someone other than the owner.

SUMMARY

In one embodiment, the invention provides a bag including a body having a first portion and a second portion defining a storage compartment therebetween. The bag further includes a zipper coupled to the body to selectively close the first and second portions. The zipper includes a slider movable along the body and a pull coupled to the slider. Further, the bag includes a bracket assembly coupled to the body. The bracket assembly includes a base defining a recess for receiving a portion of the pull, and a cover movable relative to the base between an open position, in which the cover is spaced apart from the recess to allow removal of the portion of the pull from the recess, and a closed position, in which the cover substantially covers the recess to inhibit removal of the portion of the pull from the recess. The bracket assembly further includes a first lock attachment point secured to the base and accessible through the cover. The first lock attachment point is configured to receive a first type of lock to secure the cover to the base in the closed position. The bracket assembly also includes a second lock attachment point secured to the base apart from the first lock attachment point and accessible through the cover. The second lock attachment point is configured to receive a second type of lock that is different than the first type of lock to secure the cover to the base in the closed position.

In another embodiment, the invention provides a bracket assembly for a bag with a body and a zipper coupled to the body. The zipper includes a slider movable along the body and a pull coupled to the slider. The bracket assembly includes a base defining a recess that is configured to receive a portion of the pull, and a cover movable relative to the base between an open position, in which the cover is spaced apart from the recess to allow removal of the pull from the recess, and a closed position, in which the cover substantially covers the recess to inhibit removal of the pull from the recess. The bracket assembly further includes a first lock attachment point secured to the base and accessible through the cover. The first lock attachment point is configured to receive a first type of lock to secure the cover to the base in the closed position. The bracket assembly also includes a second lock attachment point secured to the base apart from the first lock attachment point and accessible through the cover. The second lock attachment point is configured to receive a second type of lock that is different than the first type of lock to secure the cover to the base in the closed position.

In yet another embodiment, the invention provides a bag including a body having a first portion and a second portion defining a storage compartment therebetween. The bag also includes a zipper coupled to the body to selectively close the first and second portions. The zipper includes a first slider movable along the body, a second slider movable along the body, a first pull coupled to the first slider, and a second pull coupled to the second slider. The bag further includes a bracket assembly coupled to the body. The bracket assembly includes a base defining a first recess and a second recess spaced apart from the first recess. The first recess receives a portion of the first pull, and the second recess receives a portion of the second pull. The bag also includes a cover pivotally coupled to the base for movement between an open position, in which the cover is spaced apart from the first and second recesses to allow removal of the portions of the first and second pulls from the first and second recesses, and a closed position, in which the cover substantially covers the first and second recesses to inhibit removal of the portions of the first and second pulls from the first and second recesses. The bracket assembly further includes a slot formed in the base and accessible through the cover. The slot is configured to receive a portable electronic device lock to secure the cover to the base in the closed position. The bracket assembly also includes a loop extending from the base apart from the slot and accessible through the cover. The loop is configured to receive a padlock to secure the cover to the base in the closed position.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein are for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
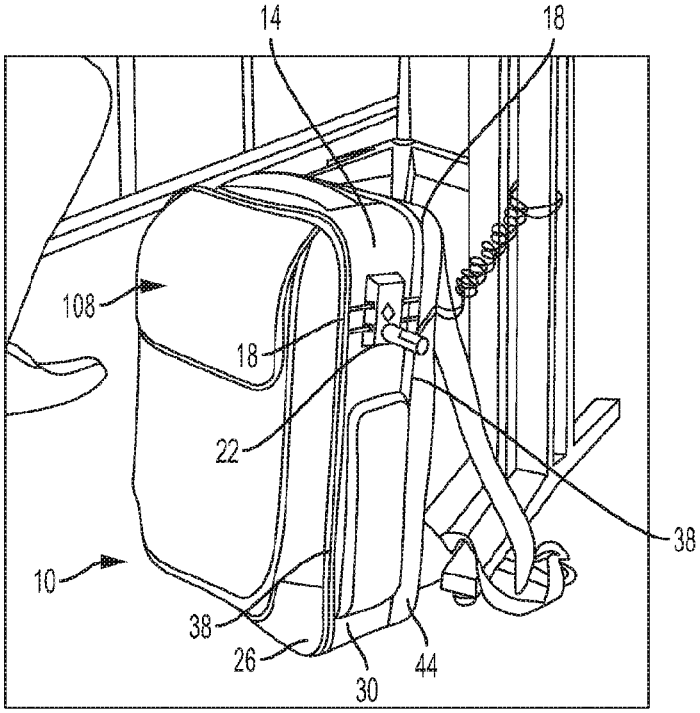
FIG. 1 is a perspective view of a bag including a bracket assembly embodying the invention.

FIG. 1 illustrates a bag 10 including a body 14, zippers 18, and a bracket assembly 22. In the illustrated embodiment, the bag 10 is a backpack. In other embodiments, the bag 10 may be any other type of bag, luggage, or storage unit having a zipper, such as a suitcase, a laptop bag, a messenger bag, a satchel, a briefcase, a backpack, and the like.

The body 14 has a first portion 26 and a second portion 30 that define a storage compartment therebetween. The first and second portions 26, 30 are coupled together by one of the zippers 18. The storage compartment is in a first side of the bag 10 and is accessible by opening the zipper 18. In the illustrated embodiment, the body 14 further has another storage compartment defined between the second portion 30 and a third portion 44. The second and third portions 30, 44 are coupled together by another zipper 18. The other storage compartment is in a second side of the bag 10 and is accessible by opening the zipper 18. Other embodiments of the body 14 may include more or fewer storage compartments and/or zippers 18.

Figure 2:
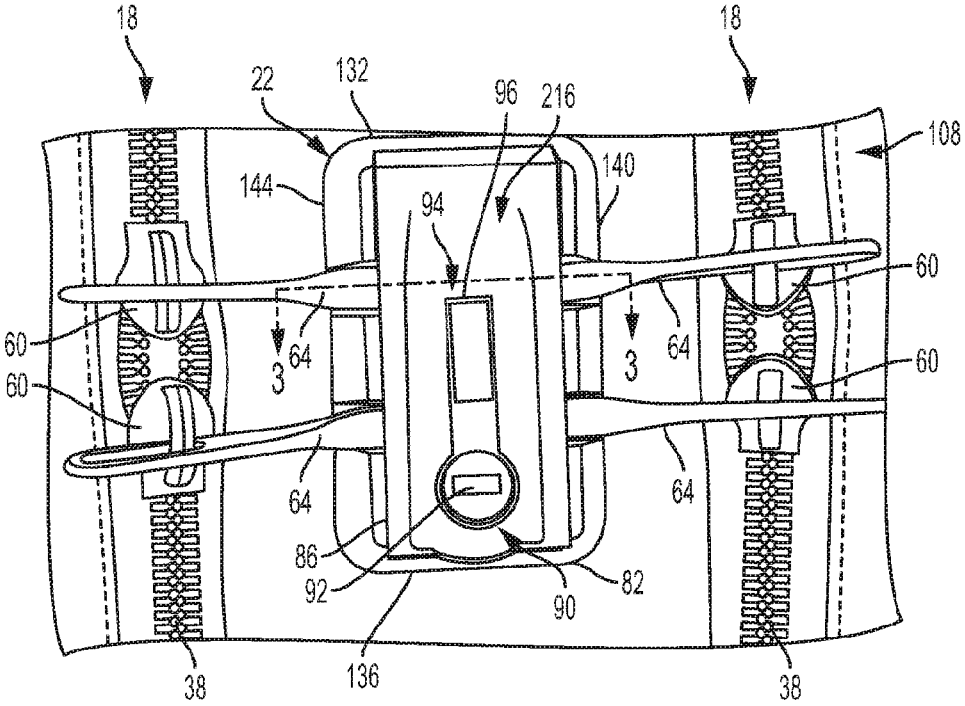
FIG. 2 is a front view of the bracket assembly including a cover in a closed position.
Figure 4:
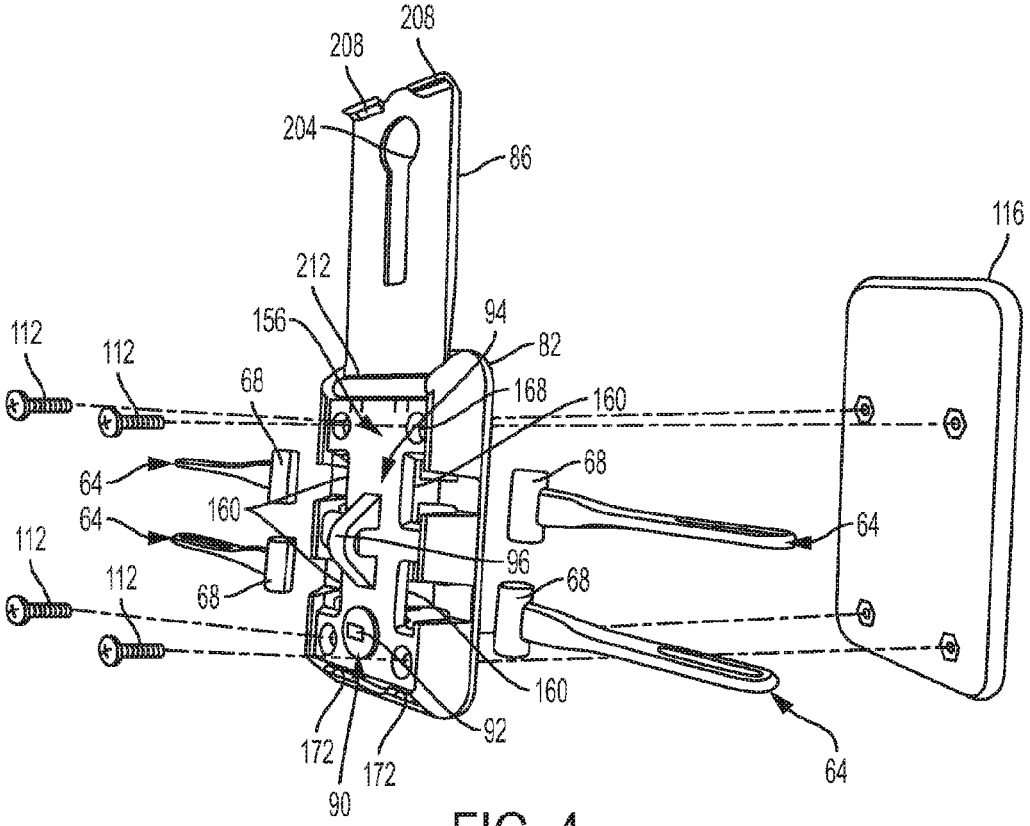
FIG. 4 is an exploded perspective view of the bracket assembly.

FIG. 2 illustrates portions of the zippers 18 in more detail. Each zipper 18 includes sliders 60 that mate with teeth 38, and pulls 64 coupled to the sliders 60. The sliders 60 are slidable along the body 14 and along the teeth 38 to open and close the storage compartments. The pulls 64 extend from the sliders 60 and are grippable by a user. The sliders 60 and the pulls 64 are coupled together by interlocking loops. In the illustrated embodiment, as shown in FIG. 4, the pulls 64 are generally T-shaped and include cylindrical heads 68. The cylindrical heads 68 are configured to be engaged by the bracket assembly 22. In other embodiments, the pulls 68 may have other suitable shapes or features to be engaged by the bracket assembly 22.

Figure 9:
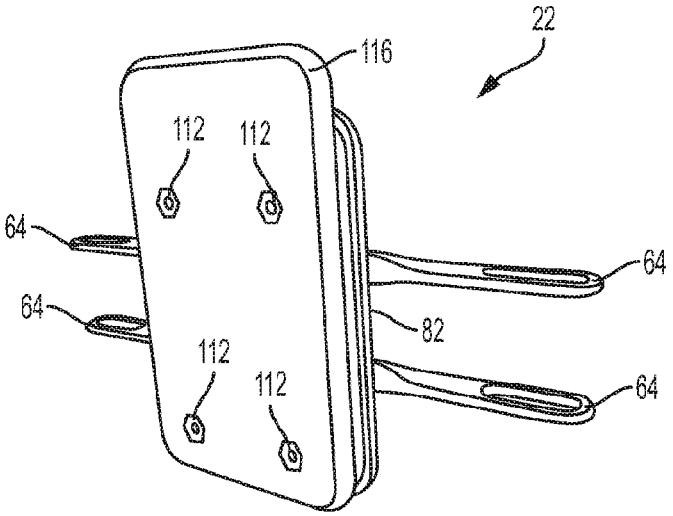
FIG. 9 is a rear perspective view of the bracket assembly.

FIGS. 2-5 illustrate the bracket assembly 22. As best seen in FIG. 4, the bracket assembly 22 includes a base 82, a cover 86, a first lock attachment point 90, a second lock attachment point 94, and a mounting plate 116. In some embodiments, the bracket assembly 22 is made of metal (e.g., steel) or a hard plastic. Referring to FIG. 2, the bracket assembly 22 is positioned on an exterior surface 108 of the body 14. The bracket assembly 22 has four edges, as viewed by a user, including a top edge 132, a bottom edge 136, a right edge 140, and a left edge 144. The right edge 140 and the left edge 144, as illustrated, are symmetrical. As shown in FIGS. 4 and 9, the bracket assembly 22 is coupled to the body 14 by fasteners 112 (e.g., screws), which also secure the body 14 to the mounting plate 116. The mounting plate 116 is arranged on an interior surface of the body 14 opposite the exterior surface 108.

Referring to FIGS. 2-5, the base 82 is substantially frustum-shaped and has rounded corners and edges. A bottom surface of the base 82 abuts the body 14. The base 82 includes an outer surface 156 defining a plane P. Four recesses 160 are formed in the outer surface 156 and extend toward the bottom surface. The recesses 160 are spaced apart from one another within the plane P. In other embodiments, the base 82 may include more or fewer recesses 160. The illustrated recesses 160 are the same shape and size. The recesses 160 are shaped to receive the cylindrical heads 68 of the pulls 68. The recesses 160 engage the cylindrical heads 68 when the cylindrical heads 68 are received in the recesses 160. In the illustrated embodiment, two recesses 160 are arranged on each of the right edge 140 and the left edges 144. The base 82 includes an outer ridge 168 extending along the perimeter of the outer surface 156 in a direction away from the plane P (see FIG. 3). The outer ridge 168 has a top with a smooth surface. The base 82 further includes projection recesses 172 formed in the bottom edge 136.

Figure 3:
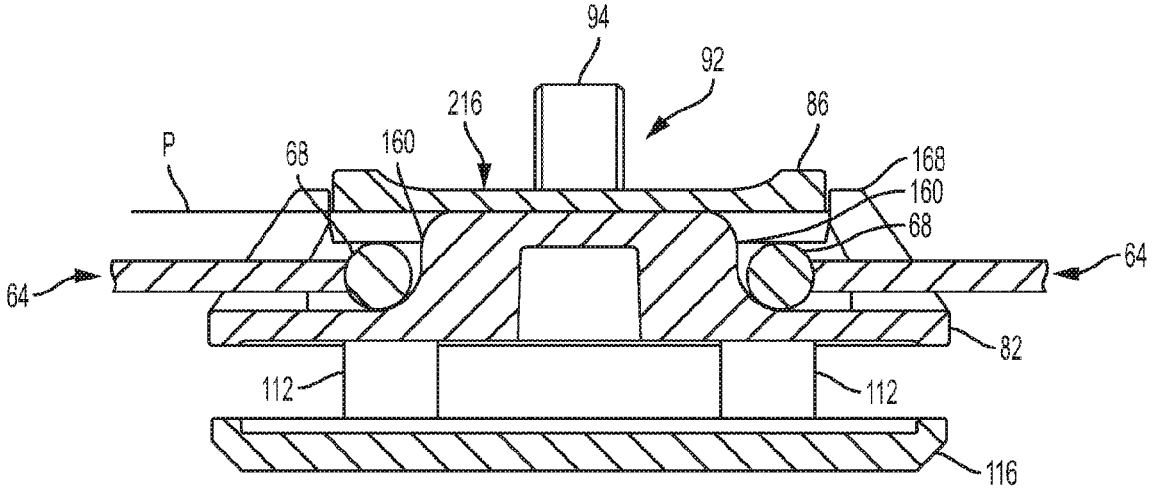
FIG. 3 is a sectional view of the bracket assembly taken along line 3-3 in FIG. 2.
Figure 5:
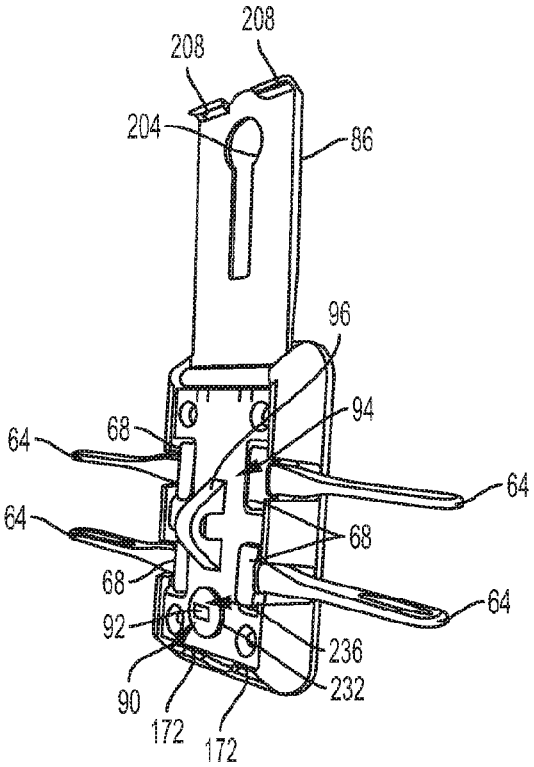
FIG. 5 is a perspective view of the bracket assembly with the cover in an open position.

Referring to FIGS. 4-5, the cover 86 is pivotally coupled to the base 82 by a hinge 212. The cover 86, as illustrated, is substantially rectangular in shape. In some embodiments, the cover is made of metal (e.g., steel). In the illustrated embodiment, the aperture 204 is "keyhole" shaped. Detents 208 are arranged on a first end of the cover 86. On a second end of the cover 86 opposite the first end, the cover 86 includes the hinge 212. The cover 86 is pivotally movable relative to the base 82 by the hinge 212 between a closed position, as shown in FIGS. 1-3, and an open position, as shown in FIG. 5. The aperture 204 provides access to the first and second lock attachment points 90, 94, when the cover 86 is in the closed position. In the illustrated embodiment, the aperture 204 is a single continuous aperture. In other embodiment, the cover 86 may include multiple discrete apertures.

In the closed position, the cover 86 substantially covers the recesses 160. Further, in the closed position the cover 86 extends parallel to the plane P. Additionally, in the closed position, the outer surface 216 of the cover 86 is generally parallel the outer ridge 168. Further, the detents 208 extending from the cover 86 engage the projection recesses 172 formed in the base 82 to releasably hold the cover 86 in the closed position. In the open position, as shown in FIG. 5, the cover 86 is spaced apart from the recesses 160 and allows access to the recesses 160 and any cylindrical heads 68 of the pulls 64 received in the recesses 160. While the cover 86 is in the open position, a user can insert the pulls 64 into and remove the pulls 64 from the recesses 160.

The first lock attachment point 90 is arranged on the base 82 proximate the bottom edge 136. In the illustrated embodiment, the first lock attachment point 90 includes a slot 92 that extends through the outer surface 156. The slot 92 is defined in an elevated portion 232 of the first lock attachment point 90. An outer surface 236 of the elevated portion 232 is flush with the outer surface 156 of the cover 86 when the cover 86 is in the closed position. The elevated portion 232 allows the slot 92 to be accessible through the aperture 204 when the cover 86 is in the closed position.

The second lock attachment point 94 is spaced from the first lock attachment point 90 along the plane P and is arranged in a center of the bracket assembly 22. In the illustrated embodiment, the second lock attachment point 94 is a loop 96 that extends outwards from the base 82 relative to the plane P. When the cover 86 is in the closed position, the loop 96 extends beyond the outer surface 156 of the cover 86. This arrangement allows the loop 96 to be accessible through the aperture 204 when the cover 86 is in the closed position.

Figure 6:
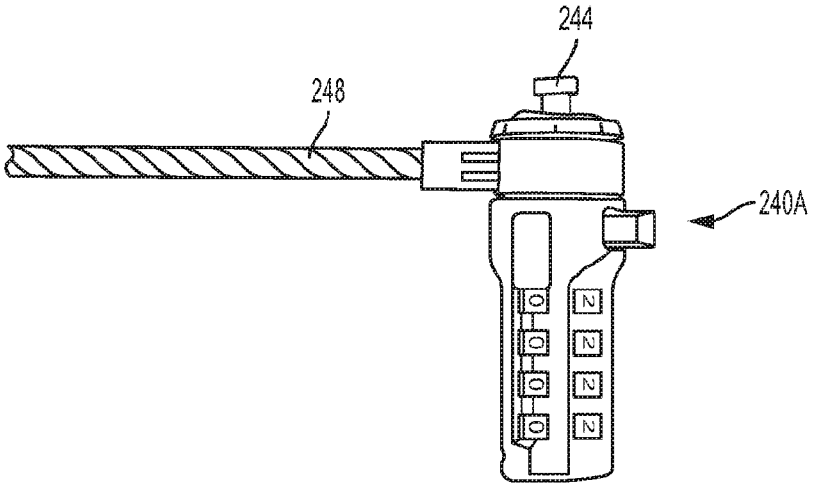
FIG. 6 is a perspective view of a first type of lock for use with the bracket assembly.

FIG. 6 illustrates a first type of lock 240A that is coupleable to the first lock attachment point 90. The illustrated lock 240A is a portable electronic device lock 240A, such as a MICROSAVER laptop lock sold by Kensington. The lock 240A is a combination lock and includes a T-bar 244 and a cable 248 (e.g., a steel cable). The T-bar 244 is shaped and sized to fit within the slot 92. The cable 248 is configured to connect to an immovable object (e.g., a desk, a chair, etc.) to secure the lock 240A (and thereby any object connected to the lock 240A) in place. In other embodiments, the first type of lock 240A may be any other suitable type of laptop lock with a cable.

Figure 7:
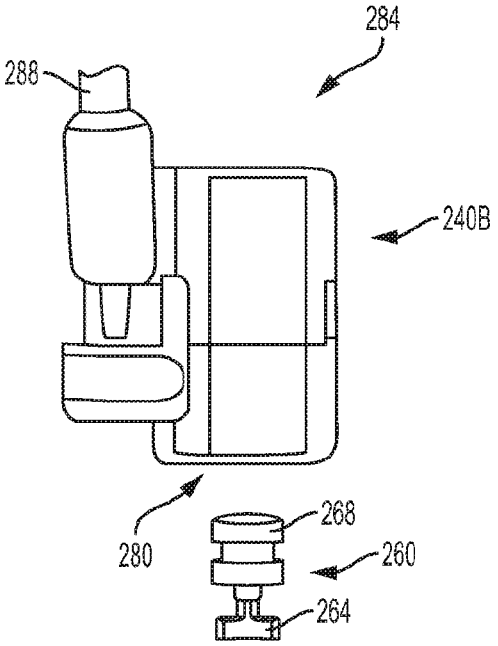
FIG. 7 is a perspective view of an adaptor and a second type of lock for use with the bracket assembly.

FIG. 7 illustrates another type of lock 240B that is coupleable to the first lock attachment point 90. The lock 240B is usable as an alternative to, or instead of, the lock 240A. The illustrated lock 240B is a portable electronic device lock, such as a CLICKSAFE laptop lock sold by Kensington. The lock 240B works in conjunction with an adaptor 260. The adaptor 260 includes a T-bar 264 on a first end and a boss 268 on a second end. The T-bar 264 is sized and shaped to fit within the slot 92. When the T-bar 264 is received within the slot 92, the boss 268 extends outwardly from the base 82 relative to the plane P. The lock 240B includes an attachment end 280 for receiving the boss 268, a key aperture 284 for receiving a key (not shown), and a cable 288.

Figure 8:
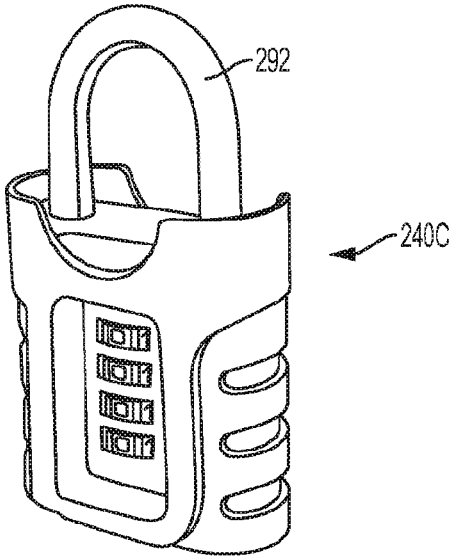
FIG. 8 is a perspective view of a third type of lock for use with the bracket assembly

FIG. 8 illustrates another type of lock 240C that is different from the locks 240A-B shown in FIGS. 6 and 7. The lock 240C couples to the second lock attachment point 94. The illustrated lock 240C is a padlock including a shackle 292 that is shaped and sized to be received in the loop 96. In the illustrated embodiment, the lock 240C includes a combination mechanism to selectively open the shackle 292. Additionally or alternatively, the lock 240C may include a key mechanism to selectively open the shackle 292. More particularly, the lock 240C can be a TSA lock that can be unlocked and opened by a TSA agent or other employee.

Each of the locks 240A, 240B, 240C (or other suitable locks) are connectable to the attachment points 90, 94 to inhibit opening the cover 86. In particular, when connected to either attachment point 90, 94, the locks 240A, 240B, 240C physically block the cover 86 from moving (e.g., pivoting) from the closed position (FIG. 2) to the open position (FIG. 5). Since the cover 86 is locked in the closed position, the pulls 64 are held in the recesses 160, inhibiting unauthorized users from opening the zippers 18.

In operation, the zippers 18 of the bag 10 are secured in the bracket assembly 22 by using the first and second lock attachment points 90, 94. First a user inserts the cylindrical heads 68 of the pulls 64 into the recesses 160. In some embodiments, the cylindrical heads 68 snap-fit into the recesses 160 by engagement with the recesses 160. For example, as shown in FIGS. 1, 2 and 5, four of the cylindrical heads 68 are received within the recesses 160. As illustrated, the zippers 18 on the right edge 140 are those that allow a user to open the storage compartment proximate the right edge 140, and the zippers 18 on the left edge 144 are those that allow a user to open the storage compartment proximate the left edge 144.

Once the zippers 18 are received in the recesses 160, the cover 86 can be moved from the open position (shown in FIG. 5) to the closed position (shown in FIG. 2). In moving the cover 86 from the open position to the closed position, the cover 86 pivots about the hinge 212. The cover 86 snap-fits into the base 82 by engaging the detents 208 with the projection recesses 172. This snap-fit arrangement releasably holds the cover 88 in the closed position before any locks 240A-240C are connected to the bracket assembly 22. In the closed position, the cover 86 substantially covers the recesses 160 and inhibits removal of the cylindrical heads 68 from the recesses 160.

After moving the cover 86 to the closed position, either or both the first lock attachment point 90, the second lock attachment point 94, or both can be used to secure the cover 86 to the base 82. The first lock attachment point 90 is used to secure the cover 86 to the base 82 by receiving the T-bar 244 of the lock 240A shown in FIG. 6 in the slot 92 and locking the lock 240A. Once the lock 240A has been secured to the bracket assembly 22, the cover 86 is secured to the base 82 in the closed position. More specifically, the cover 86 is securely held between the lock 240A and the outer surface 156 of the base 82. To remove the lock 240A from the bag 10 and allow the cover 86 to be moved from the closed position to the open position, the lock 240C is detached from the first lock attachment point 90. The lock 240A is detached by first operating the lock 240C such that the proper combination is showing on the lock 240A. The lock 240A can then be unlocked and the T-bar 244 can be removed from the slot 92.

Alternatively, the first lock attachment point 90 locks the cover 86 to the base 82 using the lock 240B shown in FIG. 7. First, the T-bar 264 of the adaptor 260 is secured in the slot 92. The adaptor 260 can then be screwed into the slot 92 to couple the adaptor 260 to the slot 92. The cover 86 is then moved to the closed position. The lock 240B is securely coupled to the bag 10 and the attachment end 280 is received over the boss 268 until the lock 240B engages the adaptor 260. Once the lock 240B is secured to the bag 10, the cover 86 has been secured to the base 82 in the closed position. More specifically, the cover 86 is securely held between the lock 240B and the outer surface 156 of the base 82. The lock 240B is detached by inserting a key into the keyhole and operating the key to unlock the lock 240B. The attachment end 280 can then be disengaged from the boss 268.

The second lock attachment point 94 locks the cover 86 to the base 82 using the lock 240C shown in FIG. 8. First, the shackle 292 is inserted into the loop 96 when the cover 86 is in the closed position. Then, the shackle 292 is received in a shackle recess (not shown) of the lock 240C to lock the lock 240C. The lock 240C is then secured to the bag 10, and the cover 86 is secured to the base 82 in the closed position. More specifically, the cover 86 is securely held between the shackle 292 and the outer surface 156 of the base 82. The lock 240C is detached by operating the lock 240C such that the proper combination is showing on the lock 240C. Alternatively, the lock 240C is detached by a TSA agent with a suitable key. Once the shackle 292 is unlocked and opened, the shackle 292 may be removed from the loop 96.

Although as described above only one of the locks 240A-C is used at a time, a combination of locks may be used to secure the cover 86 to the base 82 in the closed position. For example, the locks 240A, 240C or the locks 240B, 240C may be used in combination. In other embodiments, other types of locks may be used with the bracket assembly 22.

In some scenarios, before a lock 240A-C is used to secure the cover 86 to the base 82, the lock 240A-C is securely connectable to an immovable object (e.g., a table, a chair leg, etc.) via the cables 248, 288, as shown in FIG. 1. Once the lock 240A-C is coupled to the bracket assembly 22, the bag 10 is securely coupled to the immovable object. Theft of the contents of the bag 10 is inhibited because the pulls 64 are not removable from the bracket assembly 22 by the cover 86. Theft of the bag 10 is inhibited because the bracket assembly 22 is securely coupled to the immovable object by the cable 248, 288.

Various features and advantages of the invention are set forth in the following claims.

What is claimed is:

1. A bag comprising:

a body including a first portion and a second portion defining a storage compartment therebetween;

a zipper coupled to the body to selectively close the first and second portions, the zipper including a slider movable along the body and a pull coupled to the slider; and a bracket assembly coupled to the body, the bracket assembly including a base defining a recess for receiving a portion of the pull, a cover movable relative to the base between an open position, in which the cover is spaced apart from the recess to allow removal of the portion of the pull from the recess, and a closed position, in which the cover substantially covers the recess to inhibit removal of the portion of the pull from the recess, a first lock attachment point secured to the base and accessible through the cover, the first lock attachment point configured to receive a first type of lock to secure the cover to the base in the closed position, wherein the first lock attachment point includes a slot formed in the base, and wherein the slot is configured to receive a portable electronic device lock, and a second lock attachment point secured to the base apart from the first lock attachment point and accessible through the cover, the second lock attachment point configured to receive a second type of lock that is different than the first type of lock to secure the cover to the base in the closed position.

2. The bag of claim 1, wherein the second lock attachment point includes a loop extending from the base, and wherein the loop is configured to receive a padlock.

3. The bag of claim 1, wherein the slot is configured to alternatively receive an adaptor having a boss, and wherein the boss mates with a third type of lock that is different than the first and second types of locks to secure the cover to the base in the closed position.

4. The bag of claim 1, wherein the slider is a first slider, the pull is a first pull, and the recess is a first recess, wherein the zipper further includes a second slider movable along the body and a second pull coupled to the second slider, wherein the base defines a second recess spaced apart from the first recess, and wherein the second recess receives a portion of the second pull.

5. The bag of claim 1, wherein the recess engages the portion of the pull via a snap fit.

6. The bag of claim 1, wherein the pull is generally T-shaped and includes a cylindrical head, and wherein the cylindrical head is received in the recess.

7. The bag of claim 1, wherein the zipper is a first zipper and the recess is a first recess, further comprising a second zipper including a second slider movable along the body and a second pull coupled to the slider, wherein the base defines a second recess spaced apart from the first recess for receiving a portion of the second pull, and wherein the bracket assembly is arranged on the bag between the first and second zippers.

8. The bag of claim 1, wherein the base includes an outer surface and the recess is formed in the outer surface, and wherein the cover extends parallel to a plane defined by the outer surface when the cover is in the closed position.

9. The bag of claim 8, wherein the base includes an outer ridge extending around the outer surface, and wherein an outer surface of the cover is generally parallel with the outer ridge while in the closed position.

10. The bag of claim 1, wherein the cover defines an aperture, and wherein when the cover is in the closed position, the first lock attachment point and the second lock attachment point are accessible through the aperture.

11. The bag of claim 1, wherein the cover includes a detent that engages the base to releasably hold the cover in the closed position.

12. The bag of claim 1, wherein the bracket assembly includes a mounting plate arranged on an interior surface of the body, wherein the base is arranged on an exterior surface of the body, and wherein the mounting plate is secured to the base to mount the bracket assembly to the body.

13. The bag of claim 12, wherein the bracket assembly includes threaded fasteners extending through the body to secure the mounting plate to the base.

14. The bag of claim 1, wherein the cover is pivotally coupled to the base.

15. A bracket assembly for a bag having a body and a zipper coupled to the body, the zipper including a slider movable along the body and a pull coupled to the slider, the bracket assembly comprising:

a base defining a recess that is configured to receive a portion of the pull;

a cover movable relative to the base between an open position, in which the cover is spaced apart from the recess to allow removal of the pull from the recess, and a closed position, in which the cover substantially covers the recess to inhibit removal of the pull from the recess;

a first lock attachment point secured to the base and accessible through the cover, the first lock attachment point configured to receive a first type of lock to secure the cover to the base in the closed position, wherein the first lock attachment point includes a slot formed in the base, and wherein the slot is configured to receive a portable electronic device lock; and a second lock attachment point secured to the base apart from the first lock attachment point and accessible through the cover, the second lock attachment point configured to receive a second type of lock that is different than the first type of lock to secure the cover to the base in the closed position.

16. The bracket assembly of claim 15, wherein the second lock attachment point includes a loop extending from the base, and wherein the loop is configured to receive a padlock.

17. The bracket assembly of claim 15, further comprising a mounting plate configured to be arranged on an interior surface of the body, wherein the base is configured to be arranged on an exterior surface of the body, and wherein the mounting plate is secured to the base to mount the bracket assembly to the body.

18. A bag comprising:

a body including a first portion and a second portion defining a storage compartment therebetween;

a zipper coupled to the body to selectively close the first and second portions, the zipper including a first slider movable along the body, a second slider movable along the body, a first pull coupled to the first slider, and a second pull coupled to the second slider; and a bracket assembly coupled to the body, the bracket assembly including a base defining a first recess and a second recess spaced apart from the first recess, the first recess receives a portion of the first pull, and the second recess receives a portion of the second pull, a cover pivotally coupled to the base for movement between an open position, in which the cover is spaced apart from the first and second recesses to allow removal of the portions of the first and second pulls from the first and second recesses, and a closed position, in which the cover substantially covers the first and second recesses to inhibit removal of the portions of the first and second pulls from the first and second recesses, a slot formed in the base and accessible through the cover, the slot configured to receive a portable electronic device lock to secure the cover to the base in the closed position, and a loop extending from the base apart from the slot and accessible through the cover, the loop configured to receive a padlock to secure the cover to the base in the closed position.

* * * * *